US007077591B2

(12) United States Patent
Gueret

(10) Patent No.: US 7,077,591 B2
(45) Date of Patent: Jul. 18, 2006

(54) PACKAGING AND APPLICATOR DEVICE INCLUDING A COUPLING MEMBER ENABLING TWO RECEPTACLES TO BE UNITED

(75) Inventor: Jean-Louis Gueret, Paris (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 10/611,808

(22) Filed: Jul. 2, 2003

(65) Prior Publication Data

US 2005/0019084 A1 Jan. 27, 2005

Related U.S. Application Data

(60) Provisional application No. 60/394,657, filed on Jul. 10, 2002.

(30) Foreign Application Priority Data

Jul. 2, 2002 (FR) ..... 02 08247

(51) Int. Cl.

| | |
|---|---|
| ***B43K 27/02*** | (2006.01) |
| ***B43K 23/02*** | (2006.01) |
| ***B05C 1/00*** | (2006.01) |
| ***A47L 1/08*** | (2006.01) |
| ***A46B 11/00*** | (2006.01) |

(52) U.S. Cl. ..... 401/18; 401/17; 401/25; 401/48; 401/131

(58) Field of Classification Search ..... 401/16, 401/17, 18, 34, 131, 25, 48; 132/314, 317; 206/430; 285/235; 220/23.2, 23.4, 23.6, 220/23.8, 23.83; 74/548–551, 300; 403/222–226
See application file for complete search history.

(56) References Cited

U.S. PATENT DOCUMENTS

| | | | | |
|---|---|---|---|---|
| 1,568,160 | A | 1/1926 | Hibbert | |
| 2,691,184 | A | 10/1954 | Miller et al. | |
| 3,338,604 | A * | 8/1967 | Van Buren, Jr. | 403/280 |
| 3,369,658 | A | 2/1968 | Hasselmann | |
| 3,592,202 | A | 7/1971 | Jones | |
| 3,945,617 | A * | 3/1976 | Callery | 366/347 |
| 4,189,057 | A | 2/1980 | Morille | |
| 4,429,786 | A | 2/1984 | Hucal | |
| D321,717 | S | 11/1991 | Hager | |
| 5,218,875 | A * | 6/1993 | Volpe et al. | 73/864.01 |
| 5,314,067 | A | 5/1994 | Strock | |
| 5,318,372 | A | 6/1994 | Besthorne | |

(Continued)

FOREIGN PATENT DOCUMENTS

EP 0238208 B1 12/1991

(Continued)

*Primary Examiner*—David J. Walczak
(74) *Attorney, Agent, or Firm*—Oliff & Berridge PLC

(57) ABSTRACT

A packaging and applicator device may include at least two receptacles. Each receptacle may contain one of a cosmetic and a care substance, a body, and a removable closure cap. The device may also include at least one coupling member capable of uniting the two receptacles in line with each other. The coupling member may be at least partially elastically deformable, and may include at least one housing. The at least one housing may be configured to receive at least part of one of the receptacles and enable the part of the one of the receptacles to be fixed to the coupling member.

27 Claims, 7 Drawing Sheets

U.S. PATENT DOCUMENTS

| | | | | |
|---|---|---|---|---|
| 5,655,554 | A | 8/1997 | Goldberg | |
| 5,765,407 | A | 6/1998 | Choo et al. | |
| 5,881,742 | A | 3/1999 | Hunsberger | |
| 5,887,740 | A | 3/1999 | Hong | |
| 5,897,262 | A | 4/1999 | Bratby-Carey | |
| 5,941,254 | A | 8/1999 | Heler | |
| 6,035,865 | A | 3/2000 | Krieger | |
| 6,276,853 | B1 * | 8/2001 | Breidenbach et al. | 401/34 |
| 6,322,864 | B1 | 11/2001 | Fresnel | |
| 6,371,131 | B1 | 4/2002 | Finocchiaro et al. | |
| 2002/0011252 | A1 | 1/2002 | Finocchiaro et al. | |
| 2002/0014253 | A1 | 2/2002 | Bengis | |
| 2002/0018688 | A1 | 2/2002 | Dumler et al. | |

FOREIGN PATENT DOCUMENTS

| | | |
|---|---|---|
| GB | 2086849 | 5/1982 |
| JP | 36-6053 | 3/1961 |
| JP | 36-13943 | 5/1961 |
| JP | 60-83514 | 6/1985 |
| JP | 61-30410 | 2/1986 |
| JP | 61-56912 | 4/1986 |
| JP | 62-204510 | 12/1987 |
| JP | 63-166598 | 7/1988 |
| JP | 3-72491 | 7/1991 |
| JP | 3086868 | 7/2002 |
| WO | WO 02/09550 A2 | 2/2002 |

* cited by examiner

PACKAGING AND APPLICATOR DEVICE INCLUDING A COUPLING MEMBER ENABLING TWO RECEPTACLES TO BE UNITED

CROSS REFERENCE TO RELATED APPLICATIONS

The present application claims the benefit of French patent application number 02-08247, filed Jul. 2, 2002 and U.S. provisional patent application No. 60/394,657, filed Jul. 10, 2002, the disclosures of which are hereby incorporated by reference.

BACKGROUND OF THE INVENTION (i) Field of the Invention

The present invention relates to packaging and applicator devices, in particular for applying at least one cosmetic or care product.

The term "cosmetic" is used to mean a cosmetic product as defined in EEC Council Directive 93/35 of Jun. 13, 1993.

(ii) Description of Related Art

U.S. Pat. No. 6,035,865 discloses receptacles configured to be united by means of a coupling member having studs suitable for engaging in setbacks provided in the bottoms of the receptacles. Each receptacle is closed by a closure cap which may carry an applicator such as a brush, for example. In order to make the closure cap more ergonomic, it can be desirable to increase its axial size so as to make it easier to hold. Nevertheless, the total size of the assembly constituted by the two receptacles united by the coupling member would then tend to become cumbersome, particularly for being carried in a handbag, for example. Furthermore, the need to make setbacks in the bodies of the receptacles for co-operating with the studs of the coupling member can be undesirable, in particular in terms of appearance.

SUMMARY AND OBJECTS OF THE INVENTION

There exists a need to benefit from a device comprising two receptacles capable of being united by a coupling member, capable of being sufficiently compact to be carried in a handbag, for example, while also being more ergonomic.

In a first aspect, the present invention provides a device for packaging and applying at least one substance, the device being characterizable by the fact that it comprises:

- at least two receptacles containing cosmetic or care substances and each comprising a body and a removable closure cap; and
- at least one coupling member capable of uniting the two receptacles in line with each other, the coupling member being elastically deformable, at least in part, and including at least one housing configured to receive at least part of a receptacle and enabling it to be fixed to the coupling member, in particular in releasable manner.

The coupling member may have two housings disposed opposite each other.

The coupling member may have at least one housing configured to be capable of receiving and holding by friction the cap of one of the receptacles. It is then possible when the closure cap carries an applicator member, to make use of the coupling member as a handle member, which can make handling the applicator member easier than when using the closure cap on its own, particularly when the axial size of the closure cap is quite small.

The coupling member may include at least one housing configured to be capable of receiving and holding by friction by the body of one of the receptacles.

The coupling member may be suitable for uniting two receptacles of different kinds and/or shapes, thus offering a wide range of possibilities in terms of appearance, and it may enable a single coupling member to be used for an entire range of receptacles having different shapes or containing different substances, for example.

The coupling member may present elasticity, enabling it to adapt to the shape of the bodies or the caps of the receptacles it receives.

In a particular embodiment of the invention, the coupling member may be constituted by a single molding of elastically deformable material, e.g. an elastomer. The coupling member may also comprise a foam.

The coupling member may present a non-slip outside surface, for example by selecting a material that is flexible, and/or rough, and/or presents portions in relief in or on its surface.

When no receptacle is engaged therein, the coupling member may present an outside surface that is substantially cylindrical, optionally circularly cylindrical. The shape of the coupling member could be different. For example, in the absence of a receptacle engaged inside it, the coupling member may present an outside surface of cross-section that passes through a minimum between two axial ends. The coupling member may thus present an hourglass-type shape, for example.

The coupling member may include a portion in the form of a bellows.

One of the housings may present an opening that is larger than the other housing, for example in order to be able to receive two receptacles of different sizes.

One of the housings may include an internal arrangement enabling air to be exhausted while the corresponding receptacle is being inserted into the housing.

Such an arrangement can make it possible, for example, to ensure that air is not held captive in the corresponding housing when a receptacle is engaged therein.

By way of example, the housing may have at least one spline parallel to the direction in which the receptacle is inserted.

In a variant, the coupling member may have a thread and/or at least one side orifice opening out into one of the housings.

The coupling member may include at least one abutment against which at least one of the receptacles can come to bear, at the end of being inserted into the coupling member.

Whether such an abutment exists or not, at least one of the receptacles may come to bear against the coupling member via a shoulder of the cap or of the body, for example.

A wall may separate the two housings inside the coupling member. Where appropriate, the wall may ensure that the housings do not communicate.

At least one of the receptacles may house an applicator member secured to the corresponding closure cap.

At least one of the receptacles may include a wiper, for example a wiper comprising a block of foam.

At least one of the housings may include an inside surface that is rough, suitable for retaining the body or the cap of a receptacle by friction, in particular an inside surface presenting projections or ribs.

The coupling member may be transparent or translucent. The coupling member may be configured to produce varying optical effects that are visible from the outside, for example goniochromatic effects, i.e. effects of color varying with viewing angle.

The substances contained in the two receptacles assembled together by means of the coupling member may be different.

In another of its aspects, the invention also provides a device for packaging and applying a substance, the device being characterizable by the fact that it comprises:

at least two receptacles, each comprising a body and a removable closure cap, at least one of the receptacles including an applicator member secured to one of the body and the cap; and a coupling member enabling the two receptacles to be united, the coupling member having at least one axial end for co-operating with that one of the body and the closure cap that is secured to the applicator member so as to enable the applicator member to be used while it is secured to the coupling member.

In another of its aspects, the invention provides a coupling member comprising a tubular body defining two housings at its opposite axial ends, each housing being configured to enable a receptacle to be engaged therein, at least in part, and to be held by friction, the housings not communicating with each other, and/or the coupling member including at least one end-of-insertion abutment for at least one of the receptacles, the abutments being disposed between the housings and being made other than by a setback in the body, and/or the coupling member being made of elastomer.

The coupling member may constitute a handle member for the user while applying the substance.

In another of its aspects, the invention provides a device for packaging and applying a substance, the device being characterizable by the fact that it comprises:

at least two receptacles each comprising a body and a removable closure cap; and a coupling member enabling the two receptacles to be united, the coupling member having at least one axial end configured to co-operate with the closure cap of one of the receptacles in order to enable it to be secured removably to the coupling member.

In another of its aspects, the invention provides a method of applying makeup characterizable by the fact that it comprises the following step:

applying makeup with an applicator member secured to a closure cap or the body of a receptacle, said cap or said body being held at least in part in releasable manner in a coupling member, said coupling member being configured to enable a second receptacle to be held, in particular in releasable manner, in line with the first receptacle.

BRIEF DESCRIPTION OF THE DRAWINGS

The invention can be better understood on reading the following detailed description of non-limiting embodiments and on examining the accompanying drawings, in which.

DETAILED DESCRIPTION OF PREFERRED EMBODIMENTS

Figure 1:
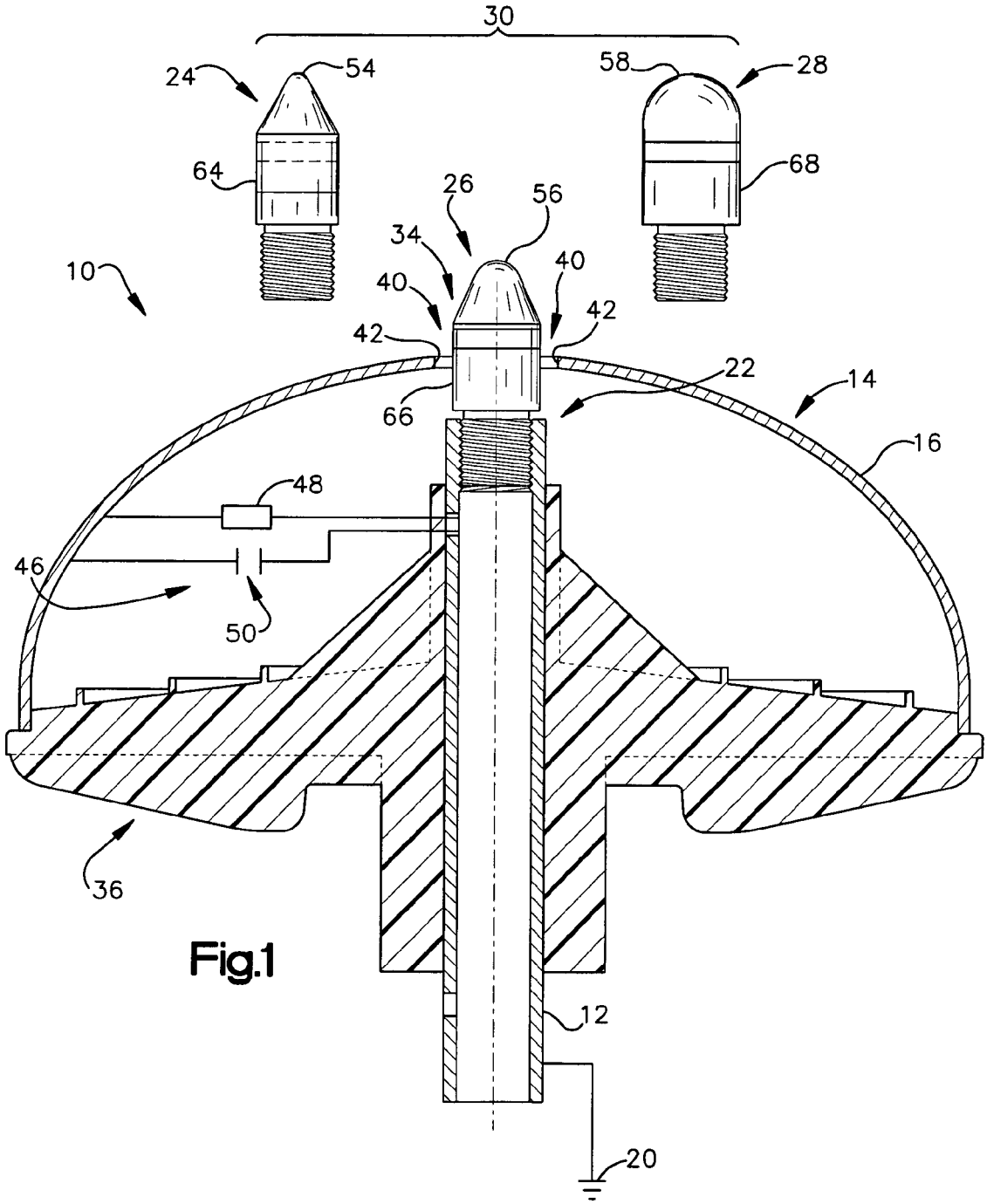
FIG. 1 is an elevation view of an example of a device made in accordance with the invention.
Figure 2:
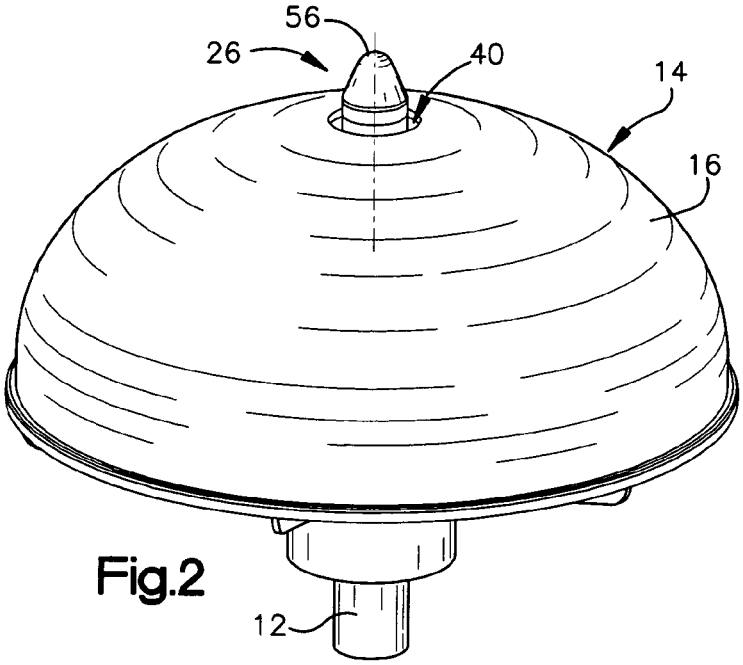
FIG. 2 is a diagrammatic axial section of the FIG. 1 device.

FIGS. 1 and 2 show a device 1 comprising two receptacles 2 and 3 united by a coupling piece 4.

As can be seen in particular in FIG. 2, each receptacle 2 or 3 comprises a body 5 containing a substance P. In the example shown, each body 5 comprises a bottom portion 6 surmounted by a fitting 7 defining a neck 8 for the receptacle and, where appropriate, capable of acting as a support for a wiper 9, e.g. constituted by a block of foam.

Each receptacle 2 or 3 also has a closure cap 10 including an assembly skirt 11 configured to screw onto the neck 8.

Each closure cap 10 serves as a handle member for an applicator member 12 which dips into the substance P inside the bottom portion 6 when the receptacle is closed, the applicator member being connected by means of a stem 15 to the closure cap 10. Each closure cap 10 presents an outside surface that is generally in then form of a dome with a flattened top.

In the example shown in FIGS. 1 and 2, the receptacles 2 and 3 are identical in outside shape, but it would not go beyond the ambit of the present invention for the receptacles to be of different shapes, as explained below.

The applicator members 12 contained in the receptacles 2 and 3 may optionally be identical, and in particular they can differ in texture and/or shape and/or kind.

In the example shown, the receptacles 2 and 3 contain different substances P, but it would not go beyond the ambit of the present invention for the substances P to be identical, with only the applicator members 12 differing, for example.

The coupling member 4 has two housings 20 and 21 opening out in opposite ends for receiving the respective receptacles 2 and 3.

In the example shown, the housings 20 and 21 are configured to be capable of receiving the closure cap 10 of the receptacles 2 and 3.

The housings 20 and 21 are defined by a wall 22 of the coupling member 4 which is generally tubular in shape about an axis X and they do not communicate with each other, being separated by a transverse wall 23 extending perpendicularly to the axis X.

The coupling member 4 is made as a single piece of elastomer material in the example described, e.g. by injection molding. The tubular wall 22 is thus capable of expanding elastically while closure caps 10 are being inserted into the housings 20 and 21.

The dimensions of the housings 20 and 21 are selected in such a manner that the closure caps 10 are held by friction inside the coupling member 4 with sufficient force to avoid unwanted separation of either of the receptacles and the coupling member, in particular while the device 1 is being carried in a handbag, for example.

Figure 3:
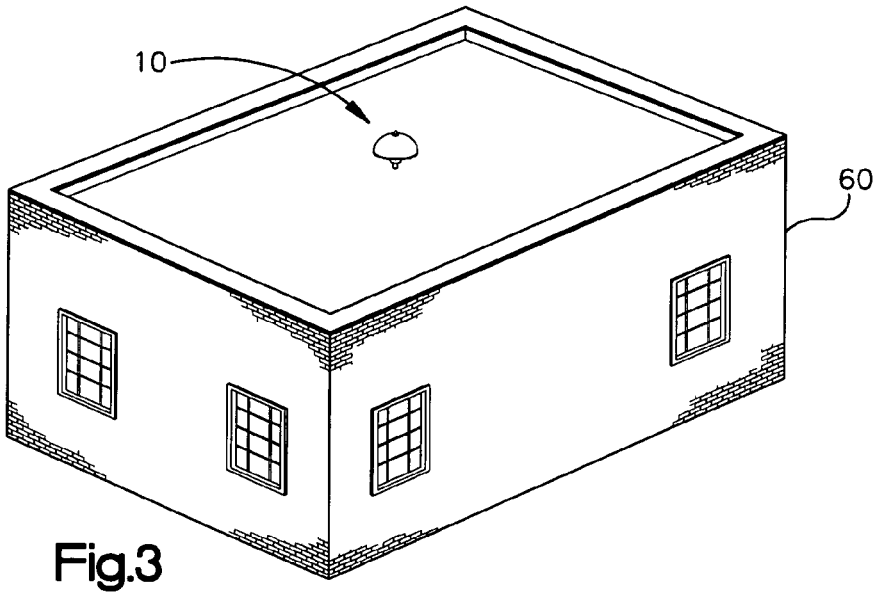
FIG. 3 shows the FIG. 1 device in use for applying makeup to the face.

In order to use one of the applicator members 12, the user unscrews one of the closure caps 10 without extracting it from the corresponding housing in the coupling member 4, and can then make use of the coupling member 4 together with the body 5 of the other receptacle, if any, as a handle member while applying substance, as shown in FIG. 3.

It will be understood that because of its size, the coupling member 4 is easy to hold. In addition, particularly when the coupling member 4 is made of an elastomer material, its outside surface may present anti-slip properties.

Naturally, it would not go beyond the ambit of the present invention to use the closure cap as a handle member for applying the substance, on its own after separating it from the coupling member.

The coupling member may present a variety of other shapes, without thereby going beyond the ambit of the present invention, and some such shapes are described below with reference to FIGS. 4 to 16.

Figure 4:
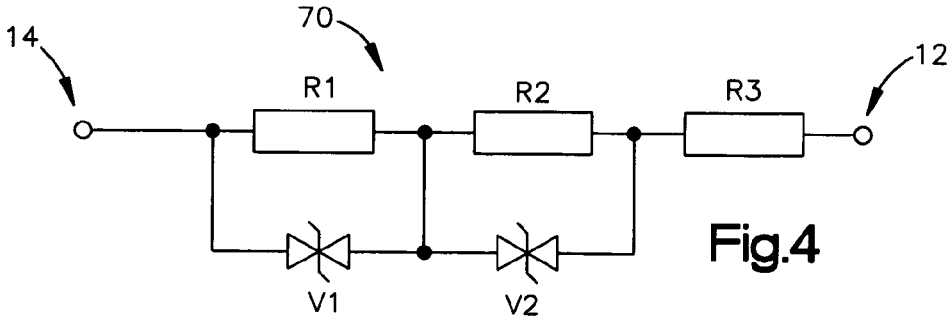
FIGS. 4 to 14 are axial section views showing various ways amongst others of making the coupling member.

The two housings 20 and 21 may communicate with each other, as shown in FIG. 4, with such communication being obtained, for example, by omitting the transverse wall 25 in the embodiment of FIGS. 1 and 2.

FIG. 4 also shows that the coupling member may be generally tubular in shape when it contains no receptacles, having an outside surface that is circularly cylindrical.

Figure 5:
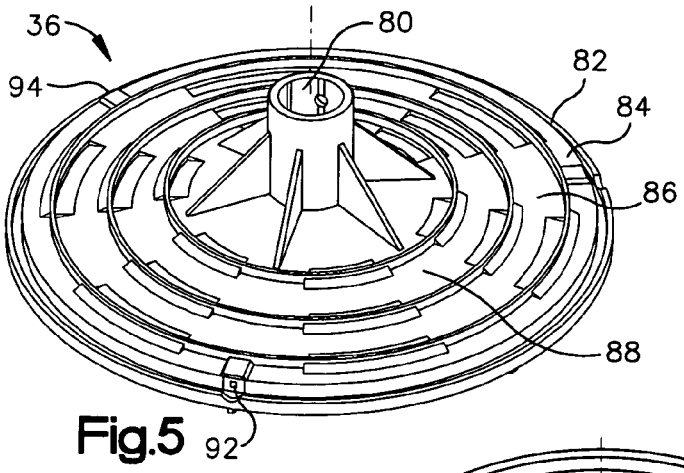

The housings 20 and 21 may communicate with each other while nevertheless presenting at least one abutment 26 between them, the receptacles coming into abutment there against when fully inserted into the coupling member 4. By way of example, the abutment 26 may be in the form of an annular rib projecting from the inside surface of the tubular wall 22. In FIG. 5, it can be seen that the abutment 26 is not implemented by a setback in the tubular wall 22.

Figure 6:
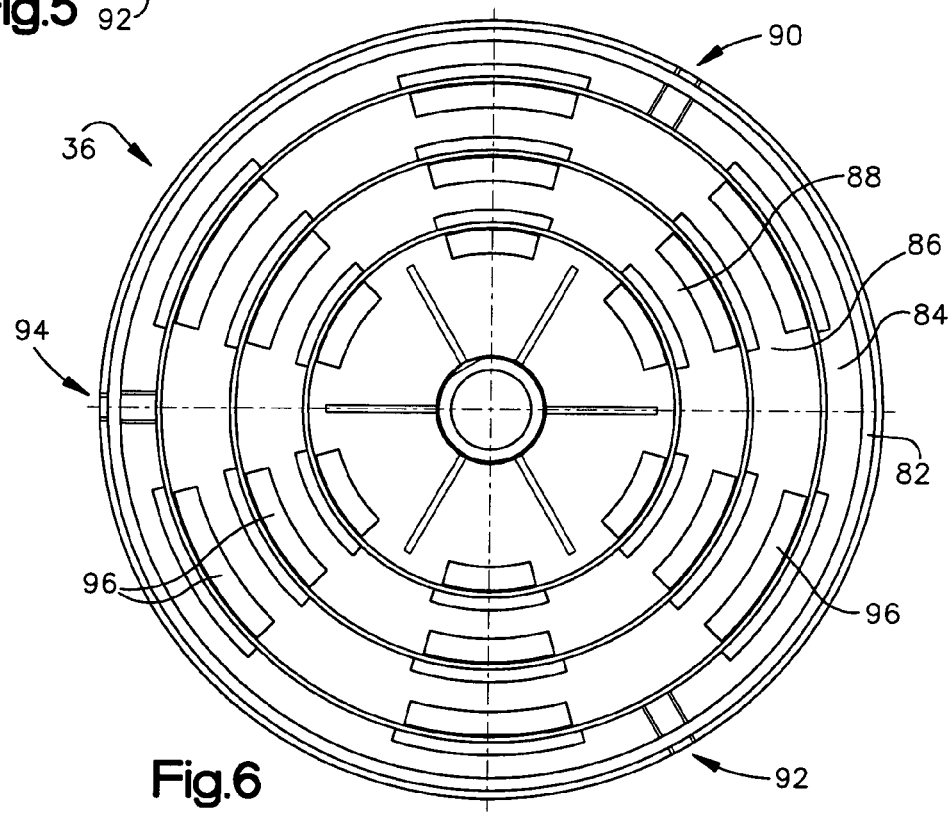

FIG. 6 shows the coupling member 4 of FIG. 5 with a closure cap 10 inserted therein. The closure cap comes into abutment against the abutment 26 and the elastically deformable coupling member 4 is slightly deformed in order to fit closely to the shape of the closure cap 10.

Figure 7:
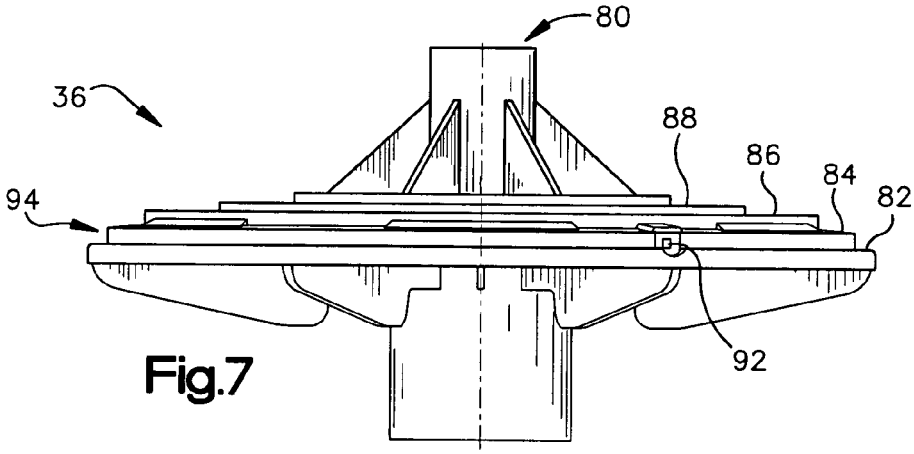

The housings 20 and 21 may be of different shapes, as shown in FIG. 7. In particular, the housings 20 and 21 may present depths and/or dimensions measured transversely to the axis X that are different.

The thickness of the wall defining the side of each housing 20 and 21 may be constant or otherwise on moving along the axis X and/or around the axis X, and it may be the same or different for the two housings 20 and 21.

Figure 8:
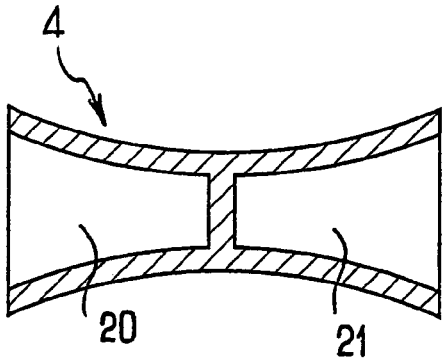
Figure 9:
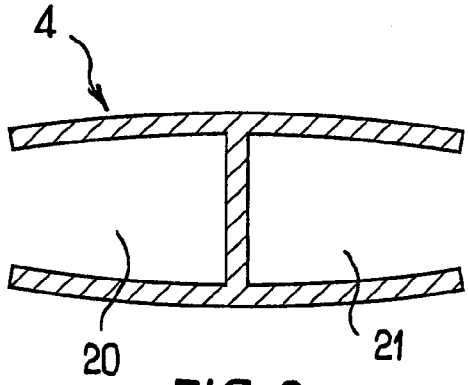

In the absence of receptacles, the outside shape of the coupling member need not be circularly cylindrical. For example, FIG. 8 shows a coupling member 4 whose outside surface is generally hourglass-shaped, being outwardly concave, while FIG. 9 shows a coupling member 4 whose outside surface is generally in the form of an American or rugby football, being outwardly convex.

Figure 10:
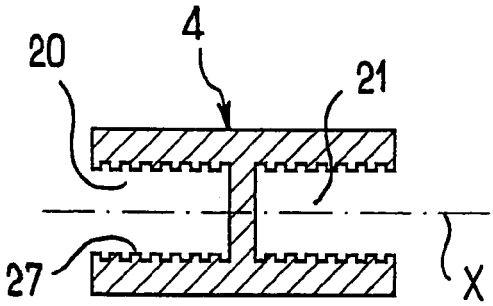

At least one of the housings 20 and 21 may include portions in relief, in particular projections or ribs for increasing friction between the receptacle and the coupling member or for conferring increased flexibility for receiving receptacles of a wide variety of shapes. By way of example, the portions in relief may be in the form of annular ribs 27, as shown in FIG. 10. At least one of the housings 20 and 21 may also include splines extending parallel to the axis X (in a variant that is not shown).

Figure 11:
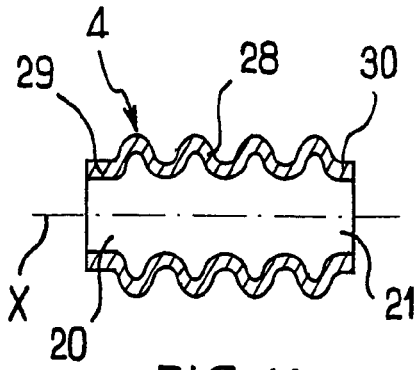

The coupling member 4 may include a portion that is axially deformable, as shown in FIG. 11. This figure shows that the coupling member may have a bellows-forming portion 28 having its ends connected to annular walls 29 and 30 defining the openings of the housings 20 and 21.

Figure 12:
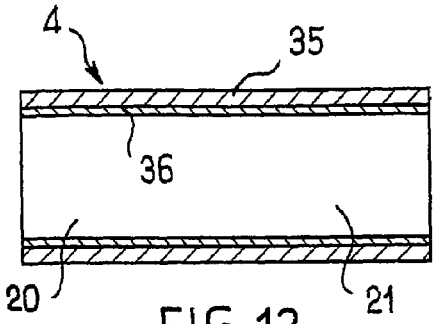
Figure 13:
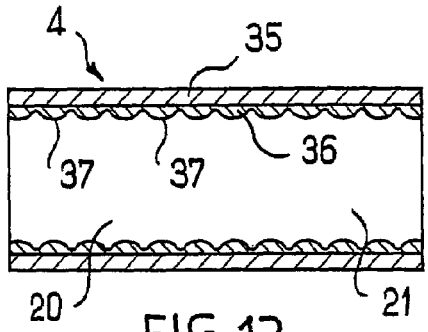

The coupling member 4 may be made entirely out of an elastically deformable material, or otherwise, for example it may comprise both an elastically deformable portion and a rigid portion, as shown in FIGS. 12 and 13.

The coupling member 4 in FIG. 12 comprises an outer rigid ring 35 and an elastomer sleeve 36 disposed inside the ring 35, e.g. stuck thereto by adhesive, and serving to define the housings 20 and 21.

FIG. 13 shows an elastomer sleeve 36 having annular ribs 37 so as to hold by friction the receptacles which the housings 20 and 21 are configured to receive.

Figure 14:
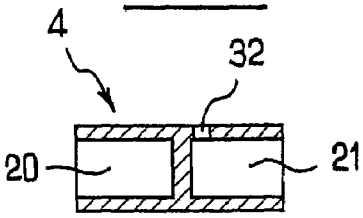

The coupling member 4 may also have at least one side orifice 32, as shown in FIG. 14. Such an orifice can allow the air contained in the housing into which it opens out to leave the housing as a receptacle is being engaged therein.

Figure 15:
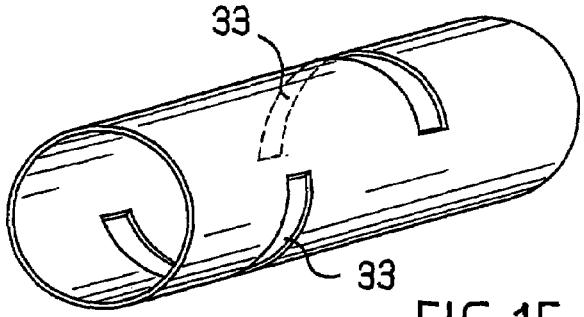
FIG. 15 is a diagrammatic perspective view of another example of a coupling member.

Each housing 20 or 21 may include a side orifice 32. These side orifices may present a variety of shapes, for example they may be in the form of slots 33 as shown in FIG. 15, with the pattern and the disposition of the side orifices being selected, where appropriate, so as to improve the appearance of the coupling member.

Figure 16:
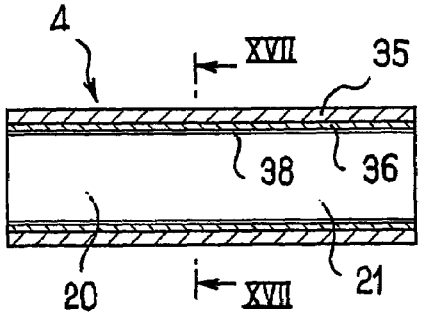
FIG. 16 is an axial section view of another embodiment of a coupling member.
Figure 17:
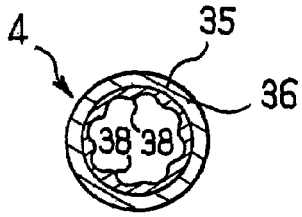
FIG. 17 is a cross-section of the coupling member of FIG. 16.

In order to evacuate the air initially contained in the housing while a receptacle is being inserted into the coupling member 4, it is possible to provide splines inside the housings 20 and 21, for example, as shown in FIGS. 16 and 17, these splines extending along the longitudinal axis of the coupling member 4, for example.

Like the coupling member shown in FIG. 12, the coupling member 4 of FIG. 16 comprises a rigid ring 35, and an elastically deformable inner sleeve 36, said sleeve having longitudinal splines 38.

FIG. 17 is a cross-section through the coupling member 4 of FIG. 16 on line XVII and shows how the splines 38 allow air to escape while a receptacle is being inserted in a housing 20 or 21 that already has a receptacle in place in the other housing.

Figure 18:
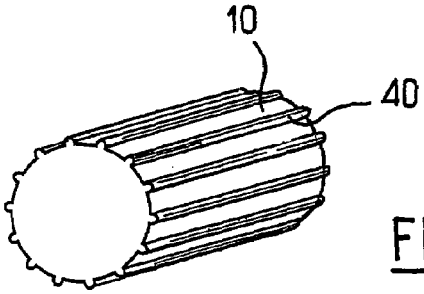
FIG. 18 is a diagrammatic perspective view of a closure cap having splines on its outside surface.

The splines 38 may be made on the coupling member 4 as shown in FIGS. 16 and 17, or they may be formed on the closure cap 10, as shown in FIG. 18.

This figure shows a closure cap 10 that is generally cylindrical in shape, having splines 40 organized around its circumference and extending parallel to its longitudinal axis.

The coupling member 4 may be made out of materials other than solid materials, for example it may be made of a cellular material, optionally an elastomer material.

Figure 19:
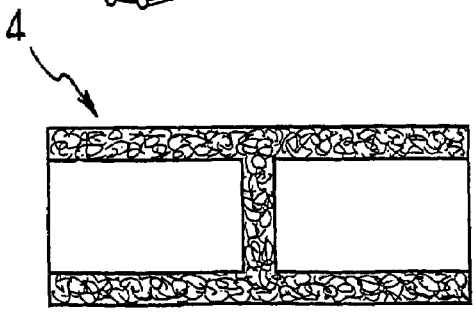
FIG. 19 is an axial section view of a coupling member made of cellular material.

By way of example, FIG. 19 shows a coupling member 4 made of foam.

As materials that are suitable for use in making the coupling member, mention can be made of silicone, latex, butyl, or nitrile elastomers; of nitrile butyl rubber (NBR), of styrene butadiene rubber (SBR), of thermoplastic elastomers, of styrene isoprene styrene (SIS), or of styrene ethylene butadiene styrene (SEBS); or of polyurethane, polyvinylchloride, polyethylene, NBR, latex, or silicone foams that have closed cells or open cells, this list not being limiting.

The housings 20 and 21 may present a variety of cross-sections, and the cross-sections of the two housings 20 and 21 may be identical or otherwise.

Figure 21:
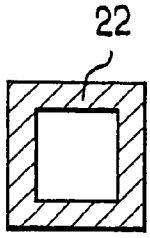
FIGS. 20 to 23 are diagrammatic cross-sections showing various possible shapes amongst others for each housing for receiving a receptacle in the coupling member.
Figure 22:
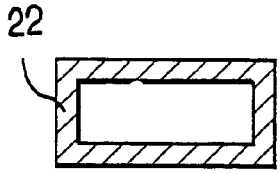
Figure 23:
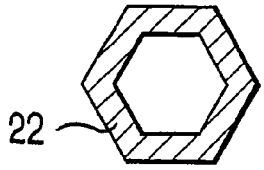
Figure 20:
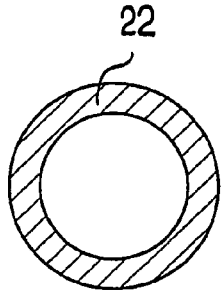

At least one of the housings 20 and 21 may be defined internally over at least a fraction of its length by a surface that is circularly cylindrical, as shown in FIG. 20, or it may be in the form of a rectangular parallelepiped of square or rectangular section as shown respectively in FIGS. 21 and 22, or it may be prismatic, in particular polygonal, e.g. hexagonal, as shown in FIG. 23.

The inside cross-section of a housing may correspond substantially to the outside cross-section of a closure cap or a body of a receptacle for insertion therein, e.g. being geometrically similar thereto.

Figure 24:
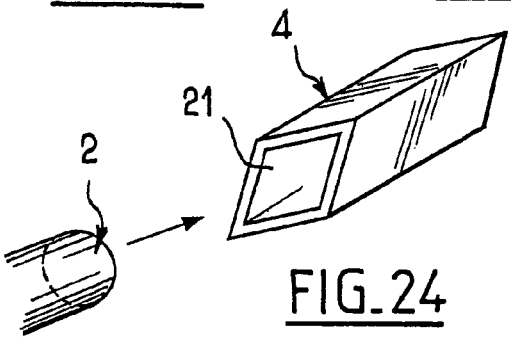
FIG. 24 shows the body of a receptacle of circular cross-section engaged in a housing of non-circular cross-section.

The inside cross-section of a housing need not present the same shape as the outside cross-section of the closure cap or the body of the receptacle, as shown in FIG. 24. In this figure, it can be seen that the coupling member can have a housing with a lozenge-shaped section, for example, while the receptacle for inserting into the housing may present a cross-section of some other shape, for example being circular of diameter slightly greater than the length of a side of the lozenge.

Figure 25:
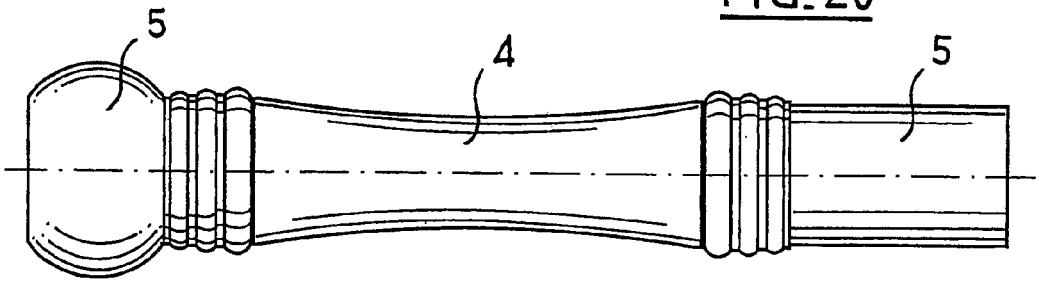
FIG. 25 shows the coupling member assembling together two receptacles having bodies of different shapes.

The coupling member 4 may receive two receptacles having bottom portions of different shapes, as shown in FIG. 25, with closure caps that are identical or otherwise.

Figure 26:
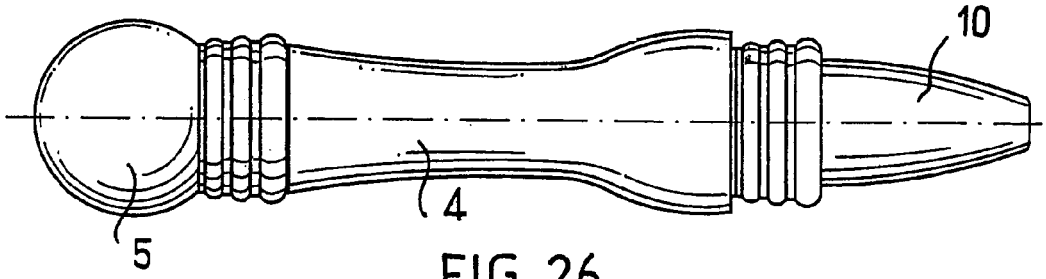
FIG. 26 shows an embodiment providing the possibility of inserting the body of the receptacle at least in part in the coupling member.

Instead of engaging two closure caps into the coupling member 4, it is also possible to engage the closure cap of one receptacle and the bottom portion of the other receptacle, for example and as shown in FIG. 26.

Figure 27:
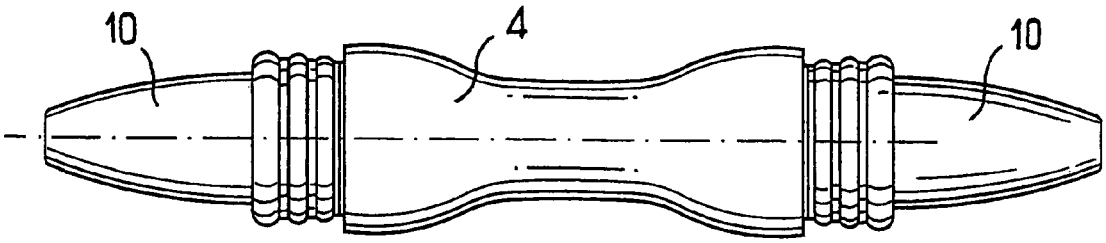
FIG. 27 shows an embodiment in which the coupling member is configured to enable the bodies of two receptacles to be engaged therein.

In the variant shown in FIG. 27, it can be seen that the bottom portions of the two receptacles can be engaged in the housings of the coupling member 4. By way of example, one of the receptacles may include an applicator member secured to the body of the receptacle, in which case the associated closure cap need not have an applicator member.

Figure 28:
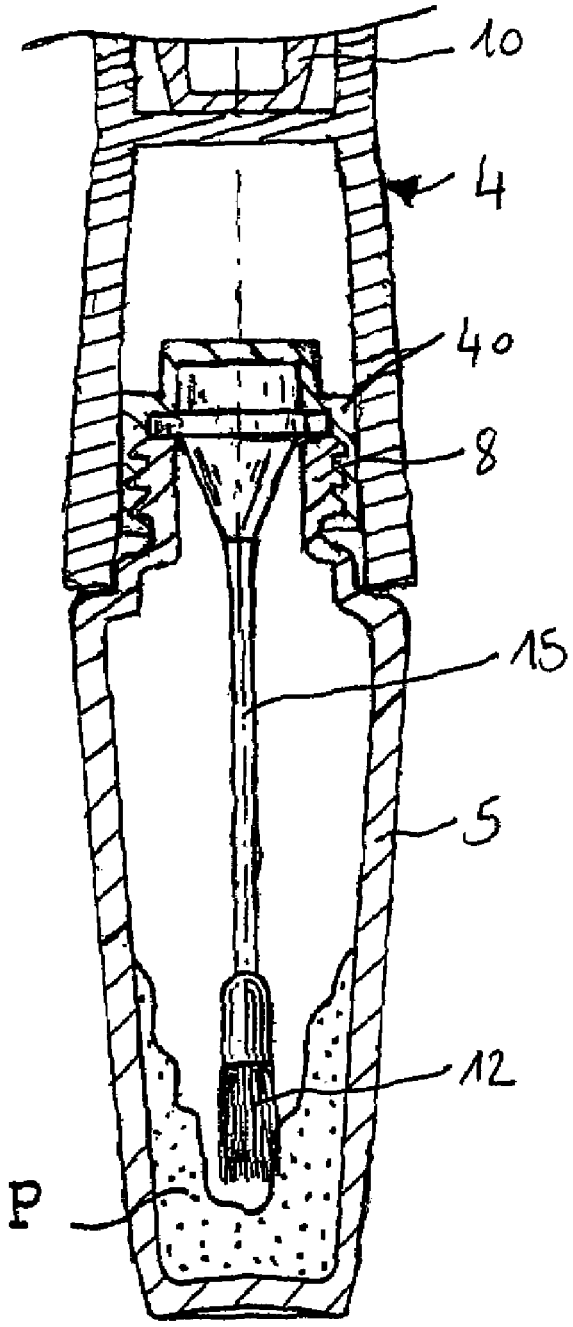
FIG. 28 is an axial and diagrammatic section view of a part of another example of a device in accordance with the invention.

In the variant shown in FIG. 28, the coupling member 4 is configured so as to allow a closure cap of a receptacle to be engaged therein, said closure cap being constituted by a conventional sub-cap 40. Such a sub-cap is generally inserted in a covering part. The coupling member 4 replace the conventional covering part.

Naturally, the invention is not limited to the examples described above.

In particular, the receptacles may optionally include wipers. The coupling member may be made in still further shapes and/or in other materials, in particular materials suitable for creating varying optical effects, in order to create animated sequences.

Throughout the description, including in the claims, the term "comprises a" should be understood as being synonymous with "comprises at least one" unless specified to the contrary.

What is claimed is:

1. A packaging and applicator device, comprising:

at least two receptacles each containing one of a cosmetic and a care substance and each comprising a body and a removable closure cap; and at least one coupling member capable of uniting the two receptacles in line with each other, the coupling member being at least partially elastically deformable and comprising at least one housing configured to receive at least part of one of the at least two receptacles and enabling it to be fixed to the coupling member.

2. A device according to claim 1, wherein the coupling member comprises a housing configured to receive and reliably hold by friction the closure cap of one of the at least two receptacles.

3. A device according to claim 1, wherein the coupling member comprises at least one housing configured to receive and releasably hold by friction the body of one of the at least two receptacles.

4. A device according to claim 1, wherein the coupling member presents elasticity enabling it to adapt to the shape of the bodies or the caps of the receptacles it receives.

5. A device according to claim 1, wherein the coupling member is constituted by a single molded piece of elastomer.

6. A device according to claim 1, wherein the coupling member has an outside surface that is non-slip.

7. A device according to claim 1, wherein the coupling member comprises a foam.

8. A device according to claim 1, wherein, when no receptacle is engaged therein, the coupling member presents an outside surface that is substantially cylindrical.

9. A device according to claim 1, wherein the coupling member includes a portion in the form of a bellows.

10. A device according to claim 1, wherein the coupling member has two axial ends and wherein, when no receptacle is engaged therein, the coupling member presents an outside surface having a cross-section that passes through a minimum between the two axial ends.

11. A device according to claim 1, including two housings and wherein one of the housings presents an opening that is larger than the other housing.

12. A device according to claim 1, wherein at least one housing includes an internal arrangement allowing air to be evacuated while the receptacle is being inserted into said housing.

13. A device according to claim 12, wherein the internal arrangement comprises at least one spline parallel to the direction in which the receptacle is inserted into the housing.

14. A device according to claim 1, wherein the coupling member has at least one side orifice opening out into a housing.

15. A device according to claim 1, wherein the coupling member includes at least one abutment against which at least one receptacle can come to bear at the end of being inserted into the coupling member.

16. A device according to claim 1, wherein the coupling member includes two housings separated by a wall.

17. A device according to claim 1, wherein said at least one housing includes an inside surface having projections or ribs.

18. A device according to claim 1, wherein the coupling member is transparent or translucent.

19. A device according to claim 1, wherein the coupling member is configured to produce varying optical effects that are visible from the outside.

20. A device according to claim 1, wherein the substances contained in the two receptacles are different.

21. A device according to claim 1, wherein at least one of the receptacles houses an applicator member.

22. A device according to claim 1, wherein the applicator member is secured to the closure cap.

23. A packaging and applicator device, comprising:

at least two receptacles each containing one of a cosmetic and a care substance, and a coupling member for coupling the two receptacles together, the coupling member being made as a single piece and comprising a tubular body defining two housings at axially opposite ends, each housing lacking a thread and being configured to enable at least part of a receptacle to be engaged therein and held by friction, and wherein the housings are not in communication.

24. A coupling member according to claim 23, one of the receptacles housing an applicator, the coupling member being configured to constitute a handle member during application.

25. A method of applying makeup, the method comprising:

applying makeup with an applicator member secured to at least one of a closure cap and a body of a receptacle, the at least one of a cap and a body being held at least partially in releasable maimer in a coupling member configured for coupling two receptacles together, the coupling member being made as a single piece and comprising a tubular body defining two housings at axially opposite ends, each housing lacking a thread and being configured to enable at least part of a receptacle to be engaged therein and held by friction, and wherein the housings are not in communication.

26. A method of applying makeup, the method comprising:

applying makeup with an applicator member secured to at least one of a closure cap and a body of a receptacle, the at least one of a cap and a body being held at least partially in releasable manner in a coupling member configured for coupling two receptacles together, the coupling member being made as a single piece and comprising a tubular body defining two housings at axially opposite ends, each housing being configured to enable at least part of a receptacle to be engaged therein and held by friction, and wherein the coupling member is a made of elastomer.

27. A device according to claim 1, wherein the coupling member lacks a thread.

* * * * *